US008196368B2

(12) United States Patent
Sarraf

(10) Patent No.: US 8,196,368 B2
(45) Date of Patent: Jun. 12, 2012

(54) DUCTILE SEISMIC SHEAR KEY

(76) Inventor: Majid Sarraf, Aliso Viejo, CA (US)

( * ) Notice: Subject to any disclaimer, the term of this patent is extended or adjusted under 35 U.S.C. 154(b) by 171 days.

(21) Appl. No.: 12/759,564

(22) Filed: Apr. 13, 2010

(65) Prior Publication Data

US 2010/0319271 A1 Dec. 23, 2010

Related U.S. Application Data

(60) Provisional application No. 61/218,369, filed on Jun. 18, 2009.

(51) Int. Cl.
*E04G 23/00* (2006.01)
*E04B 1/00* (2006.01)
*E04B 1/98* (2006.01)

(52) U.S. Cl. ..... 52/745.21; 52/98; 52/167.1; 52/167.4; 52/167.6; 52/701

(58) Field of Classification Search ..... 52/98, 167.1, 52/167.4, 167.6, 167.7, 167.8, 701, 745.21
See application file for complete search history.

(56) References Cited

U.S. PATENT DOCUMENTS

| | | | | |
|---|---|---|---|---|
| 3,921,240 | A * | 11/1975 | Fyfe | 14/73.5 |
| 4,527,365 | A * | 7/1985 | Yoshizawa et al. | 52/167.8 |
| 4,911,585 | A * | 3/1990 | Vidal et al. | 405/287 |
| 5,327,692 | A * | 7/1994 | Yano et al. | 52/167.1 |
| 5,505,026 | A * | 4/1996 | Intilla | 52/167.4 |
| 5,713,162 | A * | 2/1998 | Gallo et al. | 52/167.1 |
| 8,037,651 | B2 * | 10/2011 | Dent | 52/296 |
| 2001/0029711 | A1 | 10/2001 | Kim et al. | |
| 2003/0126695 | A1 | 7/2003 | Barrett et al. | |
| 2003/0143038 | A1 * | 7/2003 | Babcock | 405/259.1 |
| 2007/0181767 | A1 * | 8/2007 | Wobben | 248/346.01 |
| 2008/0072511 | A1 * | 3/2008 | Phuly | 52/294 |
| 2008/0282623 | A1 * | 11/2008 | Powell | 52/71 |
| 2010/0024346 | A1 * | 2/2010 | Strahin | 52/699 |

(Continued)

OTHER PUBLICATIONS

Megally, S.H., Silvia, P.F., and Seible, F., "Seismic Response of Sacrifical Shear Keys in Bridge Abutments," Structural Systems Research Report SSRP-2001/23, Department of Structural Engineering, University of California, San Diego, La Jolla, CA, May 2002.

(Continued)

*Primary Examiner* — Mark Wendell
(74) *Attorney, Agent, or Firm* — Intellectual Property Law Offices of Joel Voelzke, APC

(57) ABSTRACT

A ductile seismic shear key construction including a concrete support, a concrete shear key supported on the concrete support, a generally vertical reinforcement bar in and extending between the concrete support and the concrete shear key and anchored in the concrete support, and an isolation key. The isolation key is in and at the base of the concrete support and adjacent the reinforcement bar. The bar can be one of the two legs of a downwardly-disposed U-shaped bar. The other leg, if present, is also in and extends between the concrete support and the shear key and is anchored in the concrete support; and a second isolation key is in the concrete support at the base thereof and adjacent the second leg. The bars can pass through through-holes in the isolation keys, particularly for an interior shear key construction. For an exterior shear key construction the bars can be disposed in notches of the isolation key. Horizontal reinforcement bars can be placed perpendicular to the vertical bars (legs) and directly above the isolation key(s) and secured to the vertical bars.

41 Claims, 7 Drawing Sheets

U.S. PATENT DOCUMENTS

| | | | | |
|---|---|---|---|---|
| 2010/0107514 | A1* | 5/2010 | Black et al. | 52/91.3 |
| 2011/0061321 | A1* | 3/2011 | Phuly | 52/297 |

OTHER PUBLICATIONS

Bozorgzadeh, A., Megally, S.H., Ashford, S., and Restrepo, J.I., "Seismic Response of Sacrificial Exterior Shear Keys in Bridge Abutments," Structural Systems Research Report SSRP-04/14, Department of Structural Engineering, University of California, San Diego, La Jolla, CA, Oct. 2007.

Bozorgzadh, A., Megally, S., Restrepo, J.A., and Ashford, S.A., "Capacity Evaluation of Exterior Sacrificial Shear Keys of Bridge Abutments," Journal of Bridge Engineering, Sep./Oct. 2006, pp. 555-565.

Ashford, Scott. A., "Seismic Response and Capacity Evaluation of Exterior Sacrificial Shear Keys of Bridge Abutments," 2009 Caltrans-PEER Seismic Seminar Series (17 pages).

Caltrans & PEER Seismic Research Seminar, Agenda, Jun. 8, 2009. (2 pages).

Ashford, Scott A., "Abutments Session," Caltrans & PEER Seismic Research Seminar, Jun. 8, 2009. (5 pages).

* cited by examiner

FIG. 5
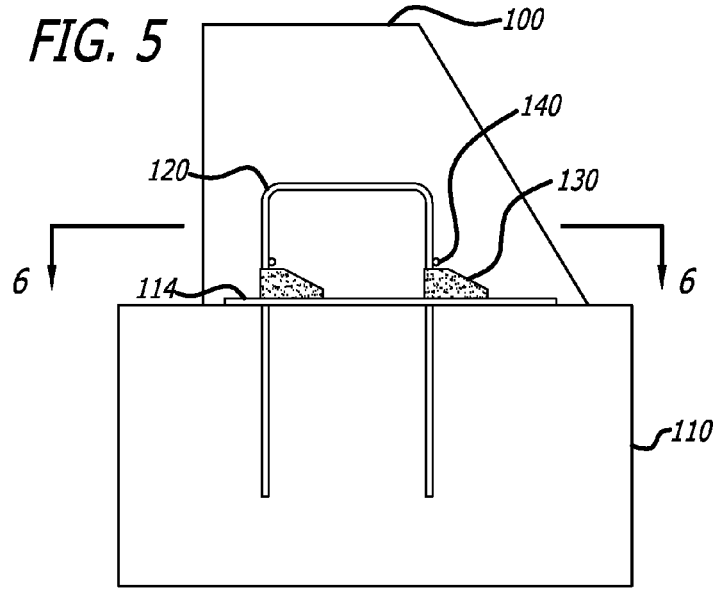
FIG. 6
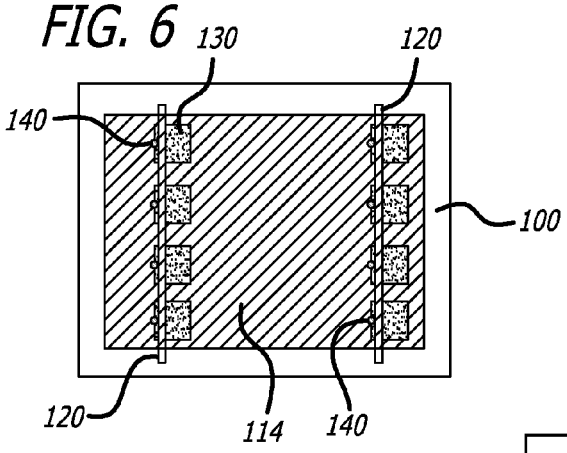
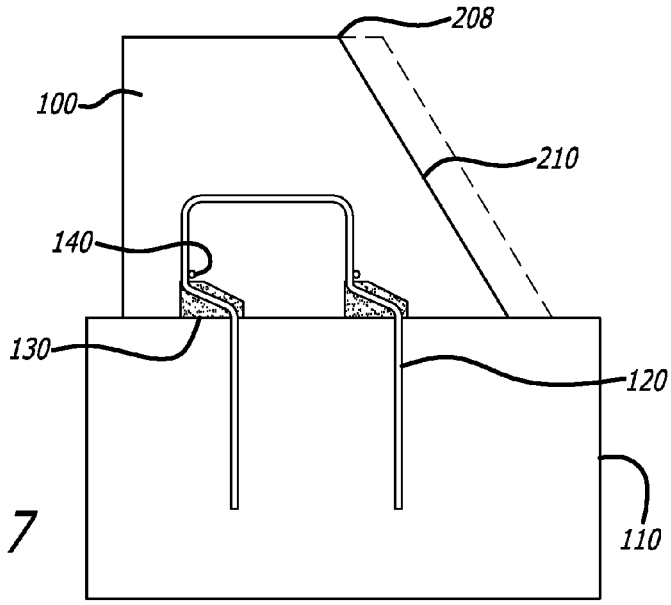
FIG. 7

FIG. 8
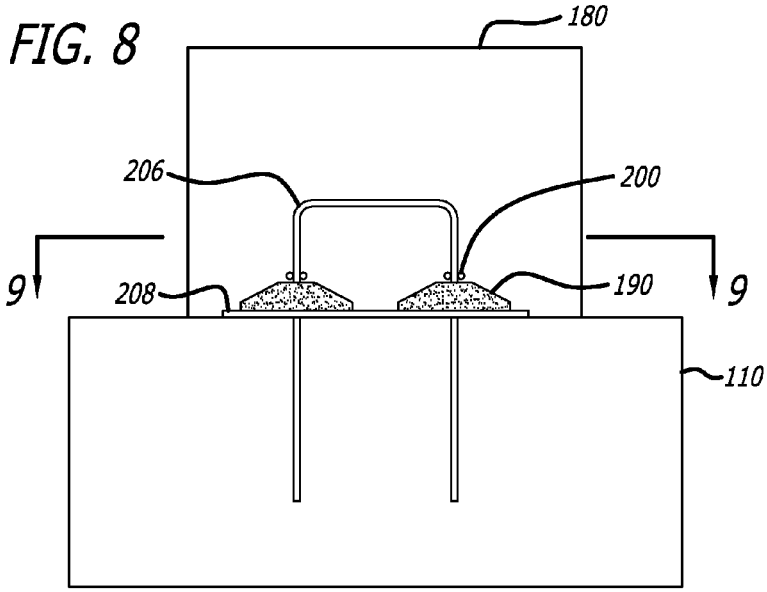
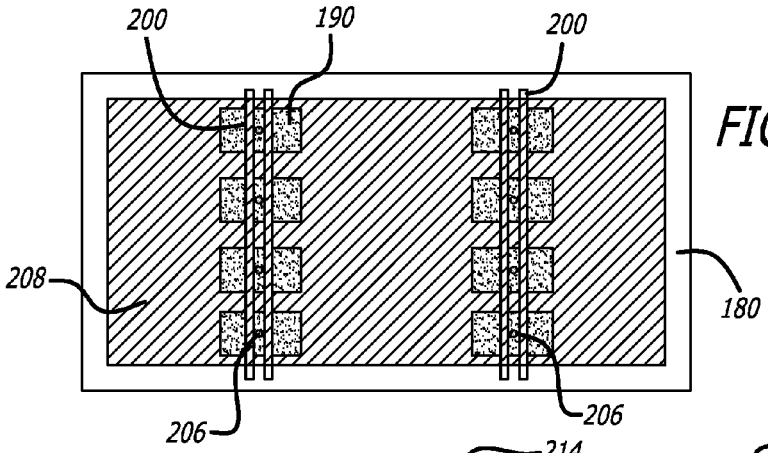
FIG. 9
FIG. 10
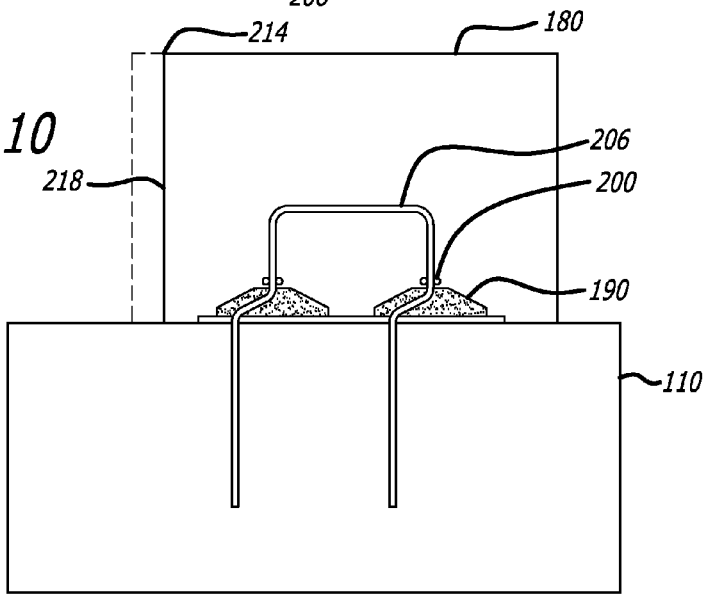

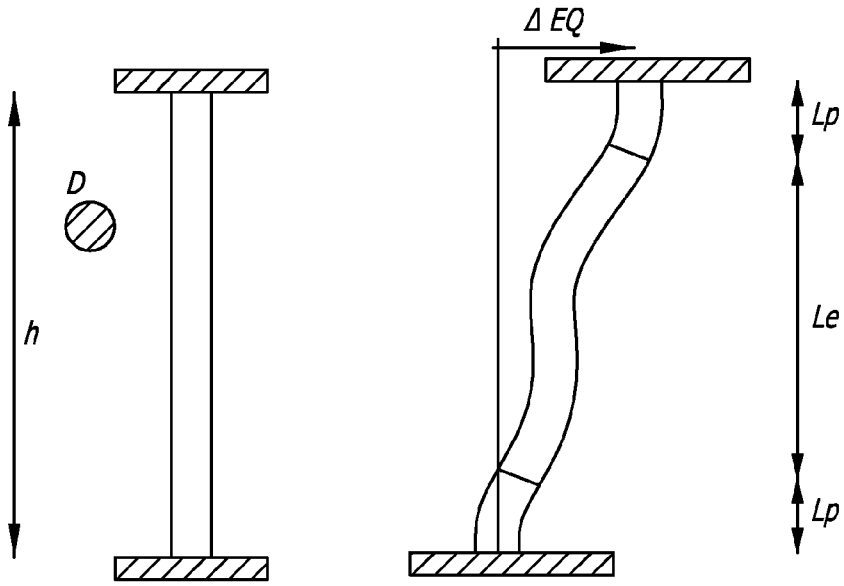
FIG. 16
FIG. 17
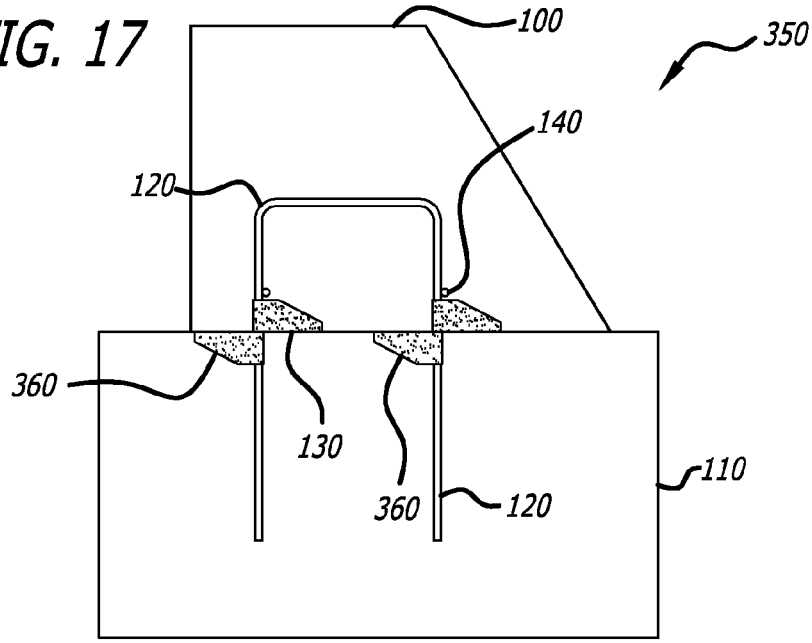

FIG. 18
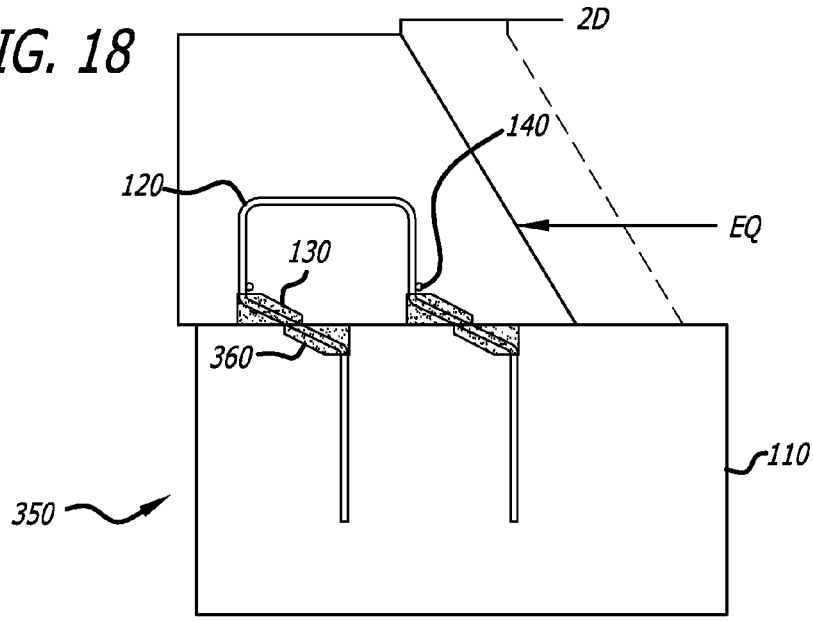
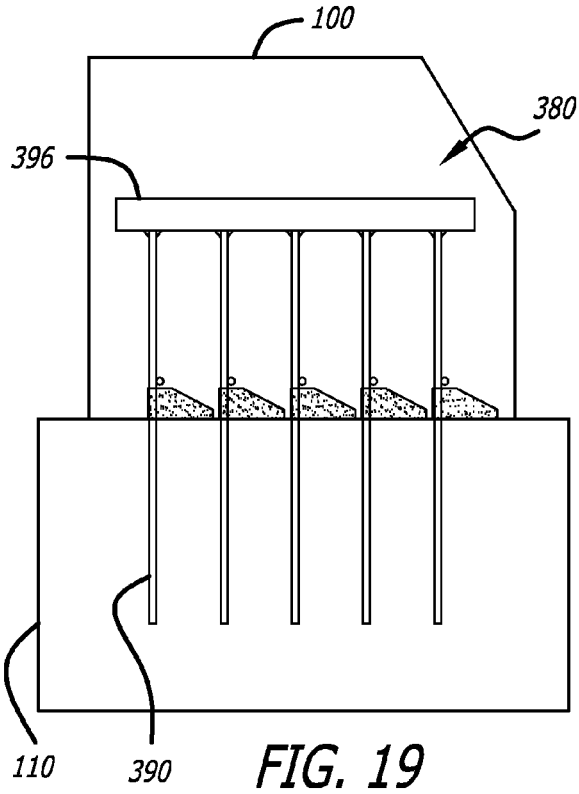
FIG. 19
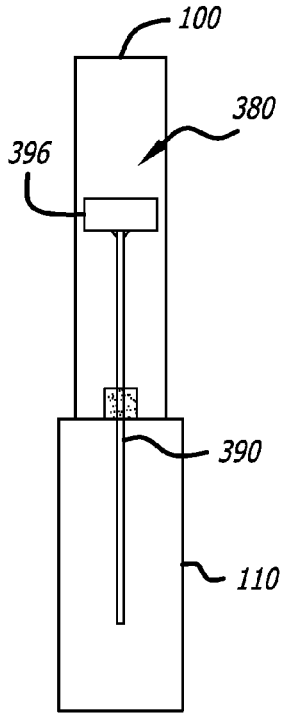
FIG. 20

DUCTILE SEISMIC SHEAR KEY

CROSS REFERENCE TO RELATED APPLICATIONS

Priority is hereby claimed to provisional application Ser. No. 61/218,369, filed Jun. 18, 2009.

BACKGROUND

An example of a conventional bridge abutment construction is shown in FIG. 1 generally at 30. Bridge abutment construction 30 includes piles 34 embedded in the ground 38 and supporting an abutment pile cap/wall 42. In a concrete box girder bridge configuration, a concrete deck slab 50 is supported on a concrete girder 46. An open cell construction 46 is supported by the cap 42 with elastomeric bearings 48 between the open cell construction and the cap. Typically, exterior shear keys 54 provide transverse support for the bridge superstructure under seismic loads.

FIG. 2 shows generally at 60 another bridge abutment construction of the prior art, which in addition to exterior shear keys 64 has interior shear keys 68. An end diaphragm 72 transfers the vertical bridge reactions to abutment pile/cap/wall 76, encircles and covers the interior shear keys 68, and overlaps the exterior shear keys 64 with a gap 78 to prevent vertical force transfer. Elastomeric bearings 80 are positioned between the end diaphragm 72 and the abutment pile cap/wall 76. Similar to FIG. 1, piles 84 are embedded in the ground 86 and support the bridge superstructure.

FIG. 3 illustrates the bridge abutment construction of FIG. 1, after having been subjected to a transverse seismic force (EQ). The concrete in the pile cap 42 may fail as shown at 90 and the piles 34 may also fail as shown at 92, depending on the magnitude of the earthquake and their relative capacities. See, e.g., Megally, S. H., Silvia, P. F., and Seible, F., "Seismic Response of Sacrificial Shear Keys in Bridge Abutments," Structural Systems Research Report SSRP-2001/23, Department of Structural Engineering, University of California, San Diego, La Jolla, Calif., May 2001. (This publication and all other publications and patents mentioned anywhere in this disclosure are hereby incorporated by reference in their entireties.)

It has been recognized that exterior shear keys can be designed as locking mechanisms that limit the magnitude of bridge transverse displacement, yet are intended to yield under a load and limit forces that can be transmitted into the abutment, thereby protecting the abutment piles from severe damage. Thus, the shear keys are expected to act as sacrificial elements to limit the transverse inertial forces in the abutment walls and the supporting piles. These sacrificial shear keys are to be designed with consideration of their over-strength to ensure that the other bridge abutment elements and the piles remain elastic under their highest anticipated capacity associated with their yielding.

FIG. 4 shows in simplified form and generally at 94 an exterior shear key construction of the prior art wherein the exterior shear keys act as sacrificial shear keys. Shear key construction 94 is described in greater detail in Bozorgzadeh, A., Megally, S. H., Ashford, S., and Restrepo, J. I., "Seismic Response of Sacrificial Exterior Shear Keys in Bridge Abutments," Structural Systems Research Report SSRP-04/14, Department of Structural Engineering, University of California, San Diego, La Jolla, Calif., October 2007 (hereinafter "Bozorgzadeh 2007 Report"). This drawing figure shows a stepped bottom surface 96 and a steel reinforcement 98. The failure mechanism of shear key construction 94 is due to excessive local elongation and local bending of the steel reinforcement associated with very limited concrete block sliding.

The "layer" at the bottom portion of the slanted edge of the shear key in Figure A4-27 of the Bozorgzadeh 2007 Report, but not illustrated in FIG. 4 herein, depicts the constant point of contact assumed to be at a level equal to the height of the bridge bearings. The yielding mechanism of the shear key in the Bozorgzadeh 2007 Report is primarily tension associated with rotation and sliding of the vertical bars in the shear key. The contact area is forced to be along the side face of the girder as the bridge superstructure moves in a translational mode.

Examples of other prior publications that mention shear keys are: U.S. Patent Publications No. 2001/0029711 (Kim et al) and No. 2003/0126695 (Barrett et al); and Bozorgzadh, A., Megally, S., Restrepo, J. A., and Ashford, S. A., "Capacity Evaluation of Exterior Sacrificial Shear Keys of Bridge Abutments," Journal of Bridge Engineering, September/October 2006, pages 555-565; and Ashford, Scott A., "Abutment Session," Caltrans & PEER Seismic Research Seminar, Jun. 8, 2009.

SUMMARY OF THE DISCLOSURE

This disclosure is related to seismic shear keys and particularly those that are designed and intended to exhibit ductile behavior under seismically induced displacement. A ductile shear key can be ideally used as a bridge sacrificial component, on the one hand, to protect the bridge abutment piles in the event of a damaging earthquake. On the other hand, it can provide sufficient lateral restraint to reduce lateral displacements of other bridge substructure components, as they can sustain large deformations prior to failure and behave in a ductile and predictable manner.

Soft isolation keys for the steel reinforcement bars of the shear key construction are disclosed herein. These isolation keys can be positioned directly adjacent the respective bars and at the bottom of the seismic shear key. They allow the steel bars to freely develop large plastic deformations when a seismic force acts on the bridge abutment.

The concrete shear keys disclosed herein significantly improve the behavior of conventional shear keys, and the shear keys of FIG. 4 and the Bozorgzadeh 2007 Report, by changing the mechanism and the source of deformation and altering the failure mode thereof. The size of the steel reinforcement bars and the geometry of the isolation blocks can be based on the anticipated seismic displacement of the structure and the required seismic performance requirements, as would be understood by those skilled in the art from this disclosure.

Exemplary embodiments are further described below with reference to the drawings, wherein like reference numerals refer to like parts.

BRIEF DESCRIPTION OF THE DRAWINGS

FIG. 5 is an elevational view of an exterior shear key construction of the present disclosure that can be adapted and used in the bridge constructions of FIGS. 1 and/or 2, for example.

FIG. 6 is a view plane through line 6-6 of FIG. 5, with the concrete of the shear key and the concrete support deleted for the sake of clarity, and showing in clearer detail the connecting horizontal cross bars thereof.

FIG. 7 is a view similar to FIG. 5, showing an exterior shear key construction of the present disclosure in a displaced condition during a major earthquake event.

FIG. 8 is an elevational view of an interior shear key construction of the present disclosure, which can be adapted and used in the bridge abutment construction of FIG. 2, for example.

FIG. 9 is a cross-sectional view taken on line 9-9 of FIG. 8 and showing the connecting cross bars thereof in clearer detail.

FIG. 10 is a view similar to FIG. 8, showing the interior shear key in a right-hand displaced condition during a seismic event.

FIG. 16 is a drawing to assist with the understanding of an equation that can be used to determine a height of the bars of an exterior shear key construction such as that of FIG. 5.

FIG. 17 is an elevational view, similar to that of FIG. 5, showing an alternative exterior shear key construction of the disclosure.

FIG. 18 is an elevational view of the exterior shear key of FIG. 17 during a seismic event.

FIG. 19 is a first elevational view of an alternative exterior shear key construction of the present disclosure, similar to those shown in FIGS. 5 and 8, but using a bar assembly in place of the stirrups in the shear key.

FIG. 20 is a second elevational view of the exterior shear construction of FIG. 19.

DETAILED DESCRIPTION

Figure 1:
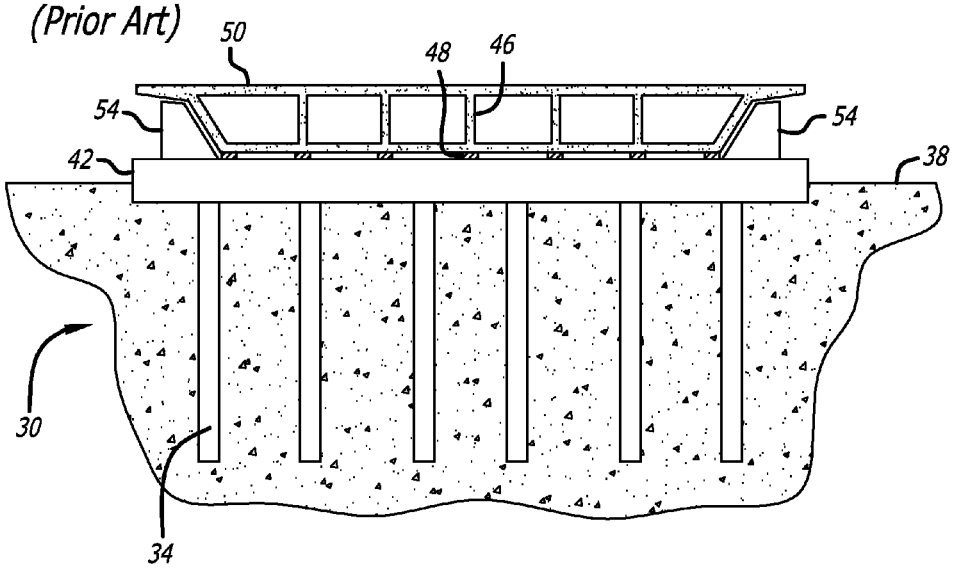
FIG. 1 (Prior Art)
FIG. 1 is an elevational cross-sectional view of a conventional bridge construction of the prior art and having exterior shear keys.

Referring to FIGS. 5 and 6, an exterior concrete shear key 100 of this disclosure can be a concrete block constructed to resist half-cycle, monotonic lateral seismic movements of a bridge superstructure and to transfer lateral loads to its concrete support 110. Shear key 100 provides restraint when the bridge moves to the left under seismic loading. The side face of the shear key 100 can be sloped or kept vertical to match the side slope of the superstructure or the end diaphragm 72 of the girder in contact at abutment or intermediate pier locations. That is, to restrain the movement to the left, the right side face can be sloped. Similarly, for a right end shear key, the left side face can be sloped to restrain movement to the right.

The concrete of the shear key 100 can be poured separately or monolithically with the concrete support 110. The core of the area of contact between the two concretes can include a thin layer of bond breaker material 114, such as plastic sheathing, building paper, inorganic bond breaker material or other thin neutral material. The thin layer 114 weakens the main interface area of the concrete so that it breaks more easily during a seismic event, while the bond in the remaining area of the interface as well as steel bars 120 is strong enough to resist non-seismic lateral loads. The remaining area in contact (the interface areas outside the bond breaker, with direct bond) provides covering/sealing of the bar reinforcements 120 from water intrusion and possible corrosion. In particular, the layer 114 can be dimensioned such that it does not extend to the edges of the key, as can be understood from FIG. 6, so as to prevent water intrusion to the bars and potential corrosion.

Figure 2:
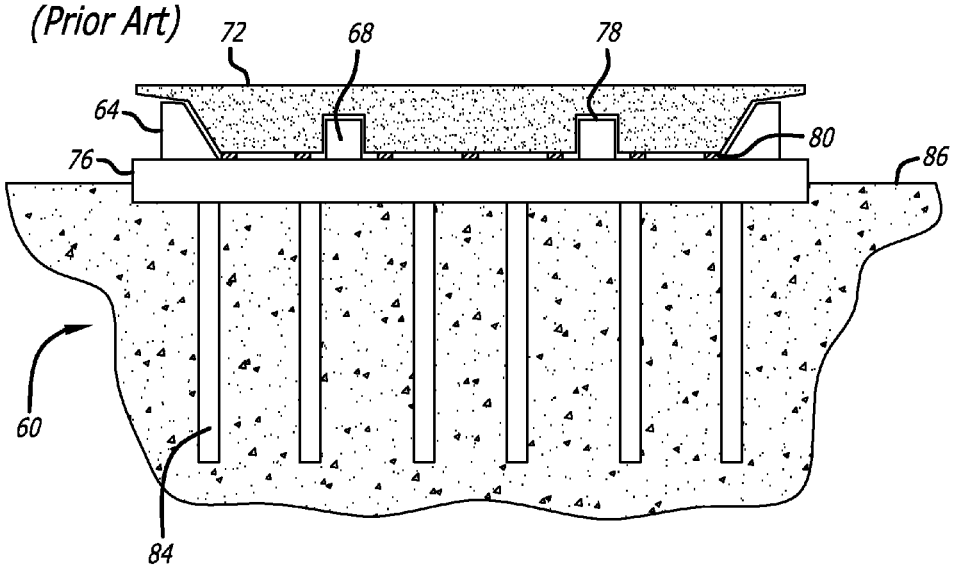
FIG. 2 (Prior Art)
FIG. 2 is an elevational cross-sectional view of a second prior art bridge construction that has exterior and interior shear keys.
Figure 3:
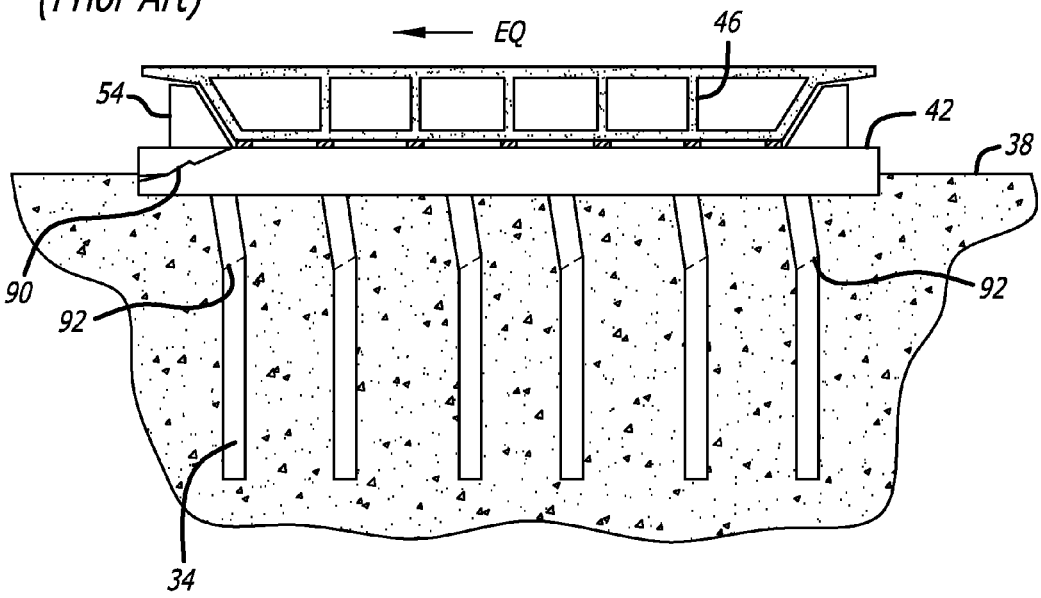
FIG. 3 (Prior Art)
FIG. 3 is an elevational view of the bridge construction of FIG. 1 in a failure condition following the application of a seismic force (EQ) thereto when the shear exhibits resistance beyond anticipated capacity.

The concrete support 110 can be commonly poured as an integral part of the abutment pile cap 42 or 76 of FIGS. 1 and 2, a footing, an end bent, an intermediate bent cap or the like. It is designed and constructed with sufficient reinforcement as an interface between the superstructure of a bridge and its foundation. It supports the shear key 100 for lateral loads as well as for bridge vertical reactions and transfers these loads to the bridge foundation.

It is efficient and economical to use the same type of concrete used for the construction of the abutment wall as the material for the ductile shear key. However, generally any inexpensive, durable material that is harder than, or has the same hardness as, the concrete material of the abutment wall or cap 110 and will not damage under direct impact from concrete can be used for the shear key. This material can be easy to cast over the reinforcement bars 120, and easily reconstructed after earthquake damage to the bars that need to be replaced.

The bars 120 can be a series of vertically positioned, downwardly inverted, U-shaped steel reinforcement bars sufficiently embedded into, or well anchored to the underlying concrete support 110. The bars 120 can be cast-in-place during the construction of the support 110. Alternatively, holes can be drilled into the concrete of the support 100 and the bars inserted into the holes and anchored to the concrete support, such as with epoxy adhesive or grout. The bars 120 are placed with sufficient distance from one another to accommodate the isolation keys 130 with a minimum of 1.5 inches of concrete, as an example, between them, as can be understood from FIG. 6, and to prevent local concrete failure behind the horizontal bars 140.

The "bars" herein are often referred to as "dowels" during construction where a concrete pour is done partially and the other half is done in a second pour. An assembly of bars pre-welded to a sufficiently thick steel plate can be used as they are all stabilized during installation. The bars welded in this fashion can be equally as effective in anchorage into concrete as U-shaped bars. That is, it is also within the scope herein to use straight bars (instead of U-shaped bars) as described below with regard to FIGS. 19 and 20, so long as sufficient development to concrete is provided.

The bars 120 are to be capable of sustaining high bending deformation without failure under anticipated seismic displacement of the shear block as shown in FIG. 7. The bars 120 can be mild steel with high ductility and low strain-hardening. They can be smooth or deformed and round, square or flat in cross-section. They can be embedded, hooked and/or anchored away from their regions of yielding or plastic deformations so as to prevent premature failure. The required area of steel can be determined to meet the applicable seismic design requirements for a bridge equipped with a shear key of this disclosure. In any case, the sum of the shear associated with the plastic over-strength bending moment of the bars 120 should, for example, not exceed the sum of the capacity of the supporting non-ductile piles or columns 84.

The exterior isolation keys 130 can be installed prior to the casting of the concrete shear key to block out the volume of the concrete to the sides of the bars 120 needed to accommodate plastic deformation of the bars following a seismic force. Specifically, the exterior isolation keys 130 can be placed on the side of the respective bars 120 opposite to the direction of shear key movement. They can have a notch 134 (FIG. 13) in which the bar is positioned or a hole, such as shown at 138 for an interior isolation key, through which the bar passes. Alternatively, the isolation key 130 can have a slit (not shown) from an edge to a nearby isolation key hole and through which the bar is passed to be positioned in the nearby hole, with the resilient isolation key material closing up the slit behind the bar.

The isolation key 130 can be made from very soft materials, such as STYROFOAM, urethane, very soft, rubber-like materials, cellulous and other polymers, that have negligible stiffness and strength as compared with that of the adjacent concrete or other shear key material. The material of the isolation key 130 can also be chemically neutral so as to neither bond to nor react with the concrete and the steel in contact under anticipated seismic displacement. The isolation key material can be generally any inorganic material that is not susceptible to corrosion and is not reactive to concrete or steel. STYROFOAM, which has a modulus of elasticity of $1/12000$ to $1/2000$, or less, of the adjacent concrete, and is commonly used for blocking out concrete, can be cut to custom shape the isolation keys. As an example, the isolation key material can have a modulus of elasticity of generally less than 2 MPa or generally between 1 and 2 MPa, as compared to the modulus of elasticity of concrete, which is generally in the range of about 23,000 to 35,000 MPa. The isolation keys 130 can even be voids within the concrete filled with nothing more than air or some other gas, including an inert gas such as dry nitrogen.

The isolation keys 130 can be positioned between a side of the respective bar 120 and the adjacent concrete so that the concrete does not contact the bars during an earthquake and thereby avoid limiting the free movement of the bars. This can be understood from FIG. 7, for example. Alternatively, a small, easily breakable amount of concrete can be disposed between the bar 120 and the isolation key 130. Thus, isolation keys 130 are disposed adjacent ductile bars 120 but need not be actually touching them, provided that when seismic loading occurs, the bars are generally free to bend into and/or out of the spaces occupied by the isolation keys without significant loss of ductility or force absorbing ability. During seismic loading, the concrete shear key moves horizontally relative to the support, and the ductile rod or bar bends into an area previously occupied by the shear key material and takes on a doubly bent shape, thereby absorbing seismic force from the seismic loading via plastic deformation of the ductile rod. The double bent shape is shown, for example, in FIG. 7.

The isolation keys 130 can alternatively be configured as large diameter, solid round or square sleeves with concentric or eccentric holes for passage of the bars 120, and can be placed on the bars 120 prior to pouring the concrete. The same soft material can be used with these alternative configurations. That is, the isolation key 130 can be a sleeve having a central through-bore for the bar. The sleeve can extend to an upper region of the bar and thereby protect adjacent concrete of the shear key against crushing by high local stresses.

Generally horizontal, steel reinforcement bars 140 can be placed perpendicular to the bars 120 and directly above the isolation keys 130. They can be positioned at potential hinging or high bending points to help prevent high stress concentrations as the vertical bars 120 bend and possibly crush the adjacent concrete. They can be secured to the bars 120 by tie wires or by tack welding. They thereby support the bars 120 in the high stress concentration regions of the concrete, directly above the isolation keys 130 and directly behind the bars being pushed away from the bridge superstructure. The size of the horizontal bars 140 can be at least the same as the vertical bars 120 or larger to prevent premature crushing of the concrete above the isolation keys 130. In addition to or in lieu of the horizontal bars 140, a steel ring (not shown) can be provided around the vertical bars 120.

Similar to bars 140, additional horizontal bars can be positioned in the concrete support 110 and beneath isolation key 130 to further secure the lower embedded portions of vertical bars 120. Thus, an alternative is to provide horizontal bars in both the shear key and in the concrete support.

As discussed above, a thin plastic sheet 114 can be positioned between the isolation key 130 and the cap or concrete support 110. The sheet 114 prevents bonding between the concrete of the two components. The two components can both have flat faces, unlike the stepped bottom surface 96 of the prior art external shear key 94 of FIG. 4. The sheet 114 thereby defines a weak plane along which the shear key can break and slide during a major event, as described earlier herein. Additionally, isolating the shear keys from the superstructure renders the shear keys an independent sacrificial element and damage thereto following an earthquake more easily repairable.

The interior shear keys, as depicted in FIGS. 8 and 9 by reference numeral 180, can be individual concrete blocks located under the bridge superstructure and away from the side face of the bridge. The "blocks" of the interior shear keys 130 can be made of materials similar to the exterior shear keys 100 as discussed above.

Since the interior shear keys 180 will be subjected to cyclic lateral displacements (as opposed to the half-cycle, monotonic lateral displacements of the exterior shear keys 100), their isolation keys 190 can be designed and configured differently than the isolation keys 130 of the exterior shear keys 100. FIG. 8 is an elevational view of an exemplary interior shear key 180. The interior isolation keys 190 can be symmetrically configured. FIG. 9 is a plan view of a cross-section of the internal isolation keys 190 and shows the location of the generally horizontal bars 200 and the generally vertical bars 206, as well as a thin sheet 208, which is similar to sheet 114.

Isolation keys 190 of interior shear keys 180 can be installed prior to the casting of the concrete shear key to block out sufficient volume of the concrete on both sides of the bars 206. The material specifications of the interior isolation keys 190 can be the same as those of the external isolation keys 130.

The interior shear key 180 can have full side contact with the end diaphragm along both sides of the interior shear key, similar to the contact between diaphragm 72 and interior shear key 68 as shown in FIG. 2. A gap between the top of the interior shear key 180 and the diaphragm 72, such as shown in FIG. 2 by gap 78, can be provided to separate the interior shear key from the diaphragm, whose concrete can be separately poured. The gap 78 can be small to increase the effectiveness of the diaphragm 72 supporting the bridge slab.

FIG. 7 shows a displaced configuration of the exterior shear key 100 when an earthquake force 210 resulting from the reaction of the superstructure with the exterior shear key is acting to the left and causes a displacement 208. Under this condition, the concrete at the interface of the shear key 100 and its support should easily separate. The seismic shear force is then transferred through the gradual double-curvature bending of the vertical bars 120 as the shear key 100 slides (to the left) with negligible resistance due to friction or concrete bond at the interface. The vertical stirrups, such as downwardly-disposed U-shaped re-bars, bend to develop significant plastic rotations associated with the imposed seismic displacement without rupturing.

Figure 11:
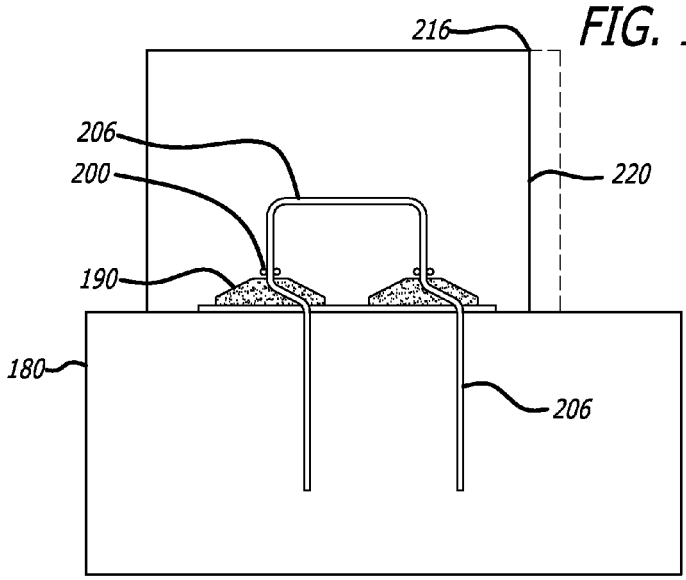
FIG. 11 is a view similar to FIG. 10, showing the interior shear key in a left-hand displaced condition during a seismic event.

In the case of interior shear keys 180, the displacements 214, 216 imposed by each half cycle of earthquake motions or forces 218, 220 can be accommodated in both right and left directions, as illustrated in FIGS. 10 and 11, respectively. When subjected to complete seismic loading cycles, the ductile steel of bar 206 absorbs seismic force multiple times by ductile bending first in one direction, and this grows in magnitude in the subsequent cycles. In the case of interior shear keys, the bars yield under load reversals without substantial loss of their ability to bend and absorb seismic loading.

The direction of the force and the displacement of the interior and exterior shear keys have been described herein as being transverse to the centerline of a bridge. Additionally, if needed, similar ductile shear keys can be designed and constructed to control a bridge seismic response for the forces acting in a longitudinal direction (parallel to the centerline of the bridge) with the isolation keys (and the vertical bars) positioned and configured to accommodate such forces, as would be apparent to those skilled in the art from this disclosure. A further alternative is a design that accommodates both lateral and longitudinal forces wherein multiple isolation keys are provided at different locations about the circumference of the vertical bars. For example, the multiple isolation keys can be designed as sleeves encircling the vertical bars. The sleeves can be cylindrical or can have wider base than tops, such as tapered sleeves.

Figure 12:
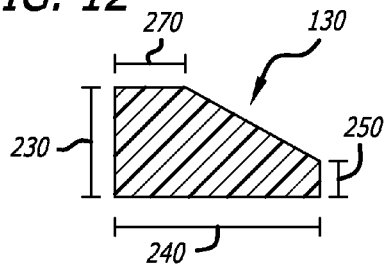
FIG. 12 is an enlarged elevational view of an isolation key of the exterior shear key of FIG. 5, illustrated in isolation and showing its configuration and dimensions.
Figure 13:
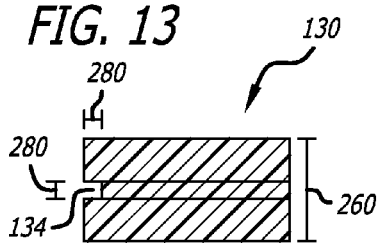
FIG. 13 is a plan view of the isolation key of FIG. 12.
Figure 14:
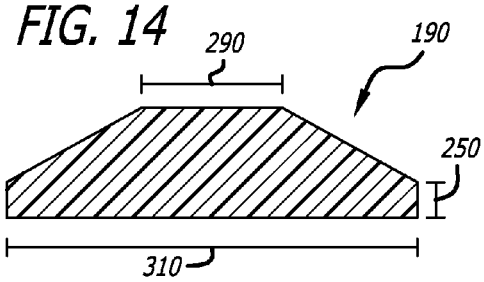
FIG. 14 is an enlarged elevational view of an isolation key of the interior shear key of FIG. 8, for example, illustrated in isolation and showing its configuration and dimensions.
Figure 15:
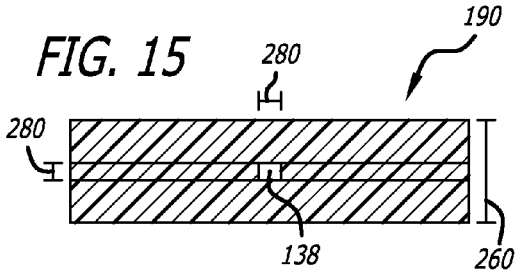
FIG. 15 is a plan view of the isolation key of FIG. 14.

A geometry of the isolation keys 130 when used to accommodate the movement of the shear key 100 to the left is shown in FIGS. 12 and 13. The isolation keys 130 can be positioned before pouring concrete for the shear key and tightened to the bars 120, such as by light wire, and a notch on the side of the isolation key to accommodate the bar. The base of the isolation key 130 can be secured to the concrete base, such as by using light clips (not shown), so that it is does not move or rotate during the placement of the concrete for the shear key 100. An interior isolation key 180 is shown in FIGS. 14 and 15 in isolation. Instead of being a single member with a through-hole, the interior isolation keys can each comprise two members (not shown), each with notches and positioned on opposite sides of the bar 120 so that the notches together form a hole for the bar. The notches can help secure the isolation key in place during concrete placement.

Parameters for sizing the isolation keys 130 can be as discussed in the paragraphs below.

The key height 230 can be determined such that under seismic displacement the imposed plastic deformation rotation on the steel bars 120 falls within deformation capacity limits of the (steel) material of the bars.

The base dimension 240 can be equal to the anticipated seismic displacement plus a safety margin to account for uncertainties associated with earthquake prediction.

The toe dimension 250 can be set to prevent damage to the toe of the soft material of the isolation key 130 (1.5 ~2 inches, for example) during the placement of the concrete for the shear key 100 as well as accommodating high local bending of the dowels/bars in the plastic region.

The width 260 of the isolation key 130 can be generally two or three times the diameter of the bars, short enough to prevent crushing and damage to the horizontal bars 140 above the isolation key.

The top dimension 270 can be generally the diameter of the bar 100, plus the diameter of the horizontal bar 140, plus an inch cover. The groove width and depth 280 can be set to accommodate the bar 120, so that the diameter thereof is the same as the bar diameter. The top dimension 290 can be generally twice the dimension 270 or three times the diameter of the bar 120. The base dimension 310 can be generally twice the dimension 240, or the anticipated seismic displacement.

The concrete outside of the isolation key 130 and 190 can be sufficiently large, strong, and reinforced, if necessary, to prevent any premature failure at the interface with the ductile response of bars 120 and 206.

The isolation keys 130, 190 for each of the bars can be joined/formed together as a (unitary) continuous member (not shown). The "wall" in this continuous member in the direction of the shear key action can be very thin. In other words, the continuous member can comprise multiple "blocks" connected in the direction perpendicular to the shear action. The continuous member can be a continuous perforated isolation block, for example. However, the remaining concrete should be sufficiently large, strong, and reinforced, if necessary, enough to prevent any premature failure.

Reference is hereby made to FIG. 16 to help explain the equation set forth and discussed directly below for calculating the clear height of the bar 120.

$$h = 60D\left(-1 + \sqrt{1 + \frac{0.24\Delta_{EQ}}{D}}\right)$$

Where, h=clear height (inches) of the bar free to deform; D=diameter of a typical bar used; and $\Delta_{EQ}$=imposed displacement (inches) on the shear key determined through seismic analysis of the bridge. This equation is based on a mechanistic model of a round steel reinforcement bar diameter D, having a length of h and a fixed end condition when it develops a maximum displacement associated with an allowable local plastic deformation at the end equal to the seismic displacement. For this model it is assumed that steel reinforcement bar 120 has the following properties: yield strength $F_y$=60 ksi; modulus of elasticity E=29,000 ksi; and ultimate strain $\epsilon_u$=0.087.

Furthermore, the bar is assumed to deform plastically at the end regions, with the length $L_p$=D, and elastically over the length $L_e$=h−2D.

The total displacement of the bar comprises the elastic deformation plus the plastic deformation associated with the limit state of strain in each region. The plastic displacements associated with the end regions are established based on an allowable limit strain of 80% of $\epsilon_u$=0.07. Considering this as an allowable strain limit, it is assumed that this level of significant plastic deformation sustained in the bar will not cause the bar to rupture in bending. Lower limits of strain can be used for a less ductile steel material, or an increased safety margin against excessive damage to the steel.

Using the same mechanistic model and assuming that corresponding plastic moment at the end regions of the bar 120 with an over-strength factor of 1.2, the number of bars required to resist the seismic shear force by all ductile shear keys 100 simultaneously engaged can be determined using the following equation.

$$n_{bar} = \frac{V_{EQ}h}{24\,D^2}$$

Where, $n_{bar}$=number of bars; and $V_{EQ}$=seismic shear demands determined through seismic analysis, excluding any friction forces, and not to exceed the capacity of other bridge substructure elements such as the piles 34, 84. The number of bars is a function of the dynamic characteristic of the bridge and the intensity of EQ at the bridge site in question, and it can be determined by an engineer. If the calculations yield more bars 120 per exterior shear key 100 than can be easily accommodated within the designated area for placement of a key, or they cannot be provided with sufficient bond and concrete cover (e.g., exceeding 5% of the gross area of the concrete) then one or more interior shear keys 180 may be needed. As examples only, an exterior (or interior) shear key 100 of the present disclosure can have twelve to thirty-six straight bars or six to eighteen U-shaped bars. The bars can be #5 or larger rebars, for example.

An equation for the height of a square (as opposed to round) stirrup re-bar embodiment can be as set forth below.

$$h = 67.6t\left(-1 + \sqrt{1 + \frac{0.21\Delta_{EQ}}{t}}\right)$$

Where, h=clear height (inches) of the square bar free to deform; t=thickness of a typical rectangular section bar (inches); and $\Delta_{EQ}$=imposed displacement (inches) on the shear key 100 determined through seismic analysis of the bridge.

The above equation is based on the same mechanistic model as the one used for the round steel reinforcement bar diameter D discussed earlier. Note that the height h is independent of the width w of the rectangular bar section. Similarly, the rectangular section bar has the following properties: yield strength $F_y$=60 ksi; modulus of elasticity E=29,000 ksi; and ultimate strain $\epsilon_u$=0.087.

Also, the rectangular bar is assumed to deform plastically at the end regions, with the plastic region length $L_p$=t, elastically over the length $L_e$=h−2t, and the plastic displacement associated with the end regions corresponds to an allowable limit strain of 80% of $\epsilon_u$=0.07.

Using the mechanistic model and assuming that the corresponding plastic moment at the end regions of the bar with an over-strength factor of 1.2, the number of bars ($n_{bar}$) required to resist the seismic shear force by ductile shear keys having rectangular sections, and simultaneously engaged can be determined using the following equation.

$$n_{bar} = \frac{V_{EQ}h}{36\,wt^2}$$

Where, w=width of the steel plate; t=thickness of a typical rectangular section dowel bar; and $V_{EQ}$=seismic shear demands determined through seismic analysis such as by an engineer.

A thin, uniform thickness STYROFOAM or the like layer (not shown) can be provided at a top portion of the slanted edge of the subject exterior shear key 100. It separates the shear key 100 from the superstructure of the bridge when they are constructed using two separate concrete pours. As the bridge superstructure moves laterally under seismic conditions, it comes into direct contact with the face of the shear key 100. The shear key is initially subjected to lateral loads at mid-depth of the structure with a sizable eccentricity with respect to the interface. As it rotates during a major seismic event, the initial contact point quickly shifts to the lowest point along the face, directly at the level of the bearing. Because, overall, the presently disclosed shear key behaves in a translational mode of displacement, it makes the performance thereof essentially insensitive to the point. As opposed to the key behavior in the prior art Bozorgzadeh 2007 Report, which is working under flexural condition and associate rotation mode, the present shear key is essentially insensitive to the location of this force.

Figure 4:
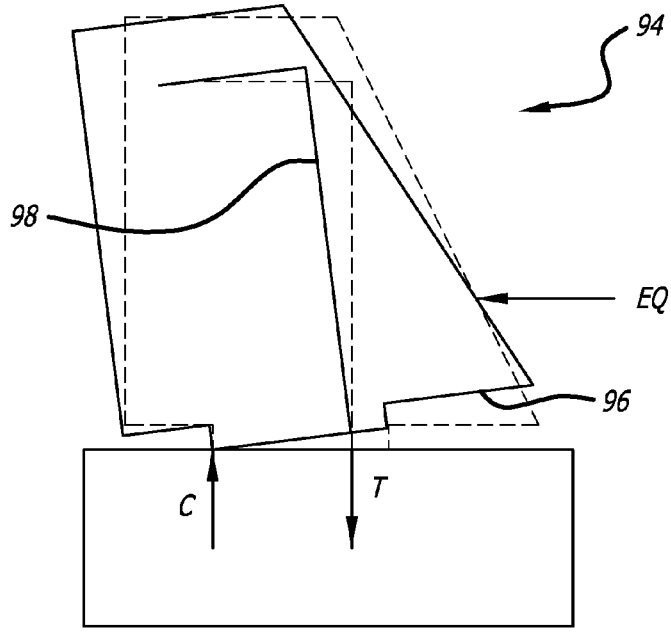
FIG. 4 (Prior Art)
FIG. 4 is an enlarged view of an exterior sacrificial shear key of the prior art, which can be used in the abutment construction of FIG. 1 for example, and showing the primary mode of behavior of the shear key in flexural/rocking when subjected to a major earthquake.

As explained below, more steel will typically be used in the construction of the present shear key 100 than the shear keys in the Bozorgzadeh 2007 Report, as depicted in simplified form in FIG. 4.

A comparison of the quantities of steel is meaningful only when bridge geometry and weight of its components are comparable and the seismic loading and the associated displacements are the same. Nevertheless, assuming that the ductile shear key 100 of the present disclosure is used to perform under the same displacement as that of the shear keys of the Bozorgzadeh 2007 Report, the present shear key can require more steel (e.g., reinforcement bars). This is because the mechanism of resisting the loads and deformations in the subject external shear key is essentially based on a "flexural" deformation of the bars, whereas in the external shear key in the Bozorgzadeh 2007 Report it is based on an "axial" deformation of the bars. While a shear key of the Bozorgzadeh 2007 Report can resist the forces associated with the displacement with less material than that of the present disclosure, it fails to maintain this level of force under larger deformations. That is, the present shear key 100 uses more steel, but in a more flexible as well as more ductile thus more reliable manner that advantageously ensures greater amounts of deformation for the key. This ductility feature is an important factor in determining what constitutes effective earthquake protection of bridges.

A good analogy as to why more steel is generally used in the present shear keys 100 than in the shear keys of the Bozorgzadeh 2007 Report is the behavior of a beam versus that of a truss. Pursuant to this analogy, the beam with a solid section resists the load by flexural action and uses more material, while the truss with material concentrated in top and bottom chords resists the internal forces through axial force action. As those skilled in the art will readily appreciate, the truss will have considerably less deflection than the beam for the same applied force and material. The present design offers more flexibility in elastic range and deformation capacity in the plastic range of deformation of the entire shear key by using steel bars in bending as well as accommodating the space for them to bend.

It should also be noted that the amount of steel used in bridge shear keys is typically very small compared to the total steel used in the entire bridge regardless of the type of shear key used. Additionally, the amount of steel or concrete or the cost associated with them is extremely small compared to the total cost of constructing the bridge, or the cost of repairing the bridge after an earthquake, should the key(s) underperform.

FIGS. 17 and 18 show generally at 350 an embodiment that is a variation of the construction of FIGS. 5 and 7. The difference is that additional isolation keys, namely lower isolation keys 360, are provided. Lower isolation keys 360 can be positioned in a top portion of the concrete support 110, adjacent the bar 120, but on the opposite side from the corresponding (top) isolation key 130 and thereby in a diagonal relationship. The lower isolation keys 360 allow for twice as much displacement capacity associated with double curvature bending of the ductile bars 120 during a seismic event (EQ), so that the bars more easily assume the double curvature configuration such as shown in FIG. 18. They can be positioned by pushing them into the top surface of the pour of the cap or concrete support 110 adjacent the bar 120, before the concrete sets. Alternatively, they can be attached to the bar 120, or otherwise fixed in position, and the concrete poured around them. They can have configurations and dimensions similar to those of the (top) isolation keys 130. Similarly, horizontal bars can be provided beneath the lower isolation keys to prevent local crushing of the concrete.

That is, the top portion of the bar 120 that is in the cap or concrete support 110 can also have a "soft retainer" or isolation key 360 and thereby the flexure of the bar passes through the interface of the isolation key and the cap or concrete support 110. In other words, the "isolation" along the bars 120 can be extended down into the supporting wall or support 110 to thereby increase the effective height of the "isolation key."

Instead of the plurality of stirrups with connecting horizontal bars, a bar assembly as shown generally at 380 in FIGS. 19 and 20 can be used. Bar assembly 380 can be a prior art bar assembly such as has been used in the prior art bridges of the type shown in FIG. 1. It can include a plurality of spaced bars 390, welded at their top ends to a plate 396. Referring to FIGS. 19 and 20, the bar assembly 380 can be positioned in the shear key and the cap or concrete support, similar to the bars in FIG. 5. Isolation keys 130 are adjacent each of the bars 390, at the base of the shear key. The isolation keys 130 can be separate for each bar, or can be connected between two or more adjacent isolation keys. Similarly, the upper and lower isolation keys 130, 360 can alternatively be used.

The present ductile exterior shear key construction has a number of advantages over the exterior shear key construction 94 of the Bozorgzadeh 2007 Report as discussed below.

The mechanistic model of the present shear key 100 is based on lateral displacement imposed on vertical steel bars to develop double-curvature flexural mode of initially elastic, leading to plastic deformations of a steel bar material behavior. This is a simple and very predictable behavior. In contrast, the shear keys of the Bozorgzadeh 2007 Report are less reliable and perform inconsistently. The bars at the onset are fully bonded while subjected to excessive tension. Thus, initially only very short lengths of the bars, if any, are free to elongate until debonding from concrete occurs. Referring to FIG. 5, this mechanism is coupled with a complex local bending and shear friction as additional compression on the sliding concrete contact area develops.

The behavior of the present shear keys is reliable, since it is based on well defined and constant boundary conditions, which are set at the time of construction of the shear keys, that is, specified and constructed free length of the steel dowel bars. Further, the behavior of the present shear keys is insensitive to the location of the reaction point. In contrast, for the shear keys of the Bozorgzadeh 2007 Report, as the magnitude and the reaction point of the lateral force acting on the face of the key changes, the moment and shearing forces change. In the prior art, it is difficult to clearly establish the portion of the bar that will develop tension yielding, since it gradually debonds from the concrete. Even further, it is difficult to establish the portion of the bar that will develop flexural yielding. Since the bending is not possible without crushing the adjacent concrete, the bar has no designated space for such deformation without damaging the concrete. Such poorly defined condition keeps changing from the onset of deformation to complete failure of the key. As both bending and tension yielding depend on crushing and debonding of the concrete, the overall response of the key disadvantageously is sensitive and variable with respect to the location of reaction point and concrete properties.

The yielding mechanism of the present shear key is reversible. That is, it performs equally well under load reversals as the plastic deformation of the bar can be recovered under reverse loading cycles, and plastic deformation in the reverse direction can develop. This allows the present shear key concept to also be used in interior shear key constructions, since the earthquake displacement can engage the (interior) shear key in both directions of movement. The interior shear constructions of this disclosure are discussed above with reference to FIGS. 8 and 9. (In contradistinction, the exterior shear keys act essentially as uni-directional devices.)

The desirable and intended mechanism of the shear keys of the Bozorgzadeh 2007 Report is only achievable under monotonic loading (one-quarter cycle of the whole earthquake). The tension-only deformation of the bars develops under monotonic loading and the residual elongation cannot be recovered under reverse cycles. This is because there is no means of compressing the already yielded steel bars, and the already crushed or debonded concrete has permanently lost its strength. Therefore, the inherent mechanism is irreversible and unrepeatable, such that this type of key cannot be effectively used as interior keys that are subjected to load reversals.

The present shear key can accommodate relatively large ranges of displacement imposed by earthquakes as it allows the steel bars 120, 206 to deform freely within the designated range of motion to develop the highest range of plastic deformation in steel bars. Accordingly, the present shear keys take advantage of full ductility of the steel bars in bending. In contrast, the effective portions of the bars of the shear keys of the Bozorgzadeh 2007 Report appear to be too short to sustain large strains, which is further combined with high local bending and shear at the sliding surface. In addition, the surrounding concrete that limits free deformation of the bars results in high initial stiffness. These are the two main reasons for having a shear key that has a low plastic deformation capability with high stiffness range before bar rupture occurs, thereby rendering the bar non-ductile.

An exterior shear key of the present disclosure can be easily repaired after a moderate earthquake when the bars are subjected to moderate seismic plastic deformation. This can be done by (hydraulically) jacking the shear block in the opposite direction of the bar deformation. External strong buttresses can be provided against which to jack; alternatively, temporary drill anchor plates secured to the existing deck and abutment can be provided against which to jack.

If the concrete of the exterior shear key has been damaged by the earthquake, the following steps can be used to repair the bridge. For minor damage, the shear key can be forced back to its original position by jacking using hydraulic jacks. For major damage, the concrete of the shear key can be removed, such as by jack hammering. The existing bars can then be saw cut at the level of the interface, new bars and drilled and bonded adjacent to the existing bars, new isolation keys positioned adjacent the new bars, and concrete poured to form a new concrete shear key. This is similar to the conventional method of replacing damaged prior art exterior shear keys.

Similarly, an interior shear key of the present disclosure can be easily repaired after a moderate earthquake when the bars are subjected to moderate to intensive seismic plastic deformation.

In contrast, the shear keys of the Bozorgzadeh 2007 Report cannot be easily repaired even after a moderate earthquake, other than by complete demolition of the concrete. This is because the mechanism for deformation damages the surrounding concrete. Therefore, the plastic deformation in the steel bars cannot be reversed by jacking in the direction opposite to the earthquake to recover tension yielding and local concrete failure.

The foregoing description refers to concrete as being a material of which the shear keys 100 and 180 and the support 110 are made. Because concrete is by far the most commonly used building material from which such structures are made, the term "concrete" has been used for readability. It will be recognized, however, that the disclosure is not strictly limited to use in concrete structures, and can be used in structures in which a building material other than concrete is used. Accordingly, the term "concrete" as used in the specification and in the appended claims should be understood to encompass concrete as well as any generally equivalent building materials, whether existing and employed now or at any time in the future.

As an example, the concrete can have a specified 28-day strength of at least 3,600 psi.

It will be understood that the terms "approximately," "about," "substantially," and "generally," as used within the specification and the claims herein, allow for a certain amount of variation from any exact dimensions, measurements, and arrangements, and that those terms should be understood within the context of the description and operation of the present disclosure.

Thus, from the foregoing detailed description, it will be evident that there are a number of changes, adaptations and modifications that come within the province of those skilled in the art. The scope of the disclosure includes any combination of the elements from the different species, embodiments, functions, sub-systems and/or subassemblies and methods disclosed herein, as would be within the skill of the art. For example, the disclosure includes the isolation keys by themselves, the bars-and-isolation keys, the shear key constructions, the shear key and support construction, and bridges and similar structures that include the isolation keys, as well as methods of making, using and repairing each of these. It is intended that all such variations not departing from the spirit thereof be considered as within the scope of this disclosure.

What is claimed is:

1. A ductile seismic shear key construction, comprising:

a concrete support;

a shear key supported on the concrete support;

a generally vertical bar in and extending between the concrete support and the shear key and anchored in the concrete support; and an isolation key in the shear key, at a base of the shear key and adjacent to the bar, wherein the isolation key is formed of a soft material having negligible stiffness and strength as compared to concrete so as to allow the bar to deform without substantial resistance by the isolation key material.

2. The construction of claim 1 wherein the shear key is a concrete shear key.

3. The construction of claim 2 further comprising a horizontal bar positioned in the shear key and connected to the vertical bar to prevent local crushing of concrete of the shear key.

4. The construction of claim 2 wherein the isolation key is configured as a sleeve around the vertical bar and extending up to an upper end region of the vertical bar to protect adjacent concrete of the shear key from crushing by high local stresses.

5. The construction of claim 2 wherein the vertical bar defines a first vertical bar and the isolation key defines a first isolation key, and further comprising:

a generally vertical second bar in and extending between the concrete support and the shear key and anchored in the concrete support; and a second isolation key in the shear key, at a base of the shear key and adjacent to the second bar.

6. The construction of claim 2 wherein the isolation key is sized to block out a volume of concrete of the concrete shear key to accommodate plastic deformation of the bar opposite to lateral movement of the shear key associated with bridge transverse and/or longitudinal movement imposed by a seismic event.

7. The construction of claim 2 wherein the bar is a first leg of a downwardly-positioned U-shaped bar having a second leg that is in and extends between the concrete support and the concrete shear key and the isolation key defines a first isolation key, and further comprising a second isolation key in the concrete support, at the base of the concrete shear key and adjacent the second leg.

8. The construction of claim 7 wherein the U-shaped bar defines a first downwardly-positioned U-shaped bar, and further comprising a second downwardly-positioned U-shaped bar having third and fourth legs, a third isolation key for the third leg and a fourth isolation key for the fourth leg, and at least one horizontal bar connecting the first and second downwardly-positioned U-shaped bars.

9. The construction of claim 2 wherein the bar is positioned in a side notch of the isolation key.

10. The construction of claim 2 wherein the shear key defines an exterior shear key.

11. The construction of claim 2 wherein the shear key defines an interior concrete shear key.

12. The construction of claim 2 wherein the concrete support is a bridge abutment pile cap or wall supported by bridge piles.

13. The construction of claim 2 wherein failure of the bar from a seismic event is primarily in a flexural mode and not in an elongation mode.

14. The construction of claim 2 wherein the mechanism of the concrete shear key of resisting loads and deformations is based primarily on a flexural mode and not on an axial mode of deformation of the bar, and the isolation key allows the bar to freely deform.

15. The construction of claim 2 wherein: the vertical bar is a first leg of an downwardly-positioned U-shaped rebar; the U-shaped rebar includes a second leg generally parallel to the first leg and connected thereto by a U-shaped portion; the U-shaped portion being disposed in the shear key; the second leg extending between the concrete support and the shear key and anchored in the concrete support; and the isolation key defines a first isolation key; and further comprising: a second isolation key in the shear key, generally at the base of the shear key and adjacent the second leg.

16. The construction of claim 15 wherein: the downwardly-positioned U-shaped rebar defines a first downwardly-positioned U-shaped rebar; the U-shaped portion defines a first U-shaped portion; and the isolation key defines a first isolation key; and further comprising:

a second downwardly-positioned U-shaped rebar having third and fourth legs and a second U-shaped portion; the third and fourth legs being in and extending between the concrete support and the shear key and anchored in the concrete support; the second U-shaped portion being in the shear key;

the first downwardly-positioned U-shaped rebar lying in a first plane, and the second downwardly-positioned U-shaped rebar lying in a second plane substantially parallel to the first plane;

a third isolation key adjacent the third leg; and a fourth isolation key adjacent the fourth leg.

17. The construction of claim 16 further comprising a connector bar connecting the first and third legs.

18. The construction of claim 17 wherein the connector bar defines a first connector bar; and further comprising a second connector bar connecting the second and fourth legs.

19. The construction of claim 17 wherein the connector bar is in the shear key.

20. The construction of claim 17 wherein the connector bar is in the concrete support.

21. The construction of claim 16 wherein the first and second or the first and third isolation keys are formed as a single continuous perforated isolation block.

22. The construction of claim 1 wherein the isolation key has a compressibility of approximately 1/20,000 to 1/12,000 of the material of the shear key.

23. The construction of claim 1 wherein the isolation key comprises a non-reactive, inorganic, polymer-like material that can be easily cut to shape.

24. The construction of claim 1 wherein the bar defines a generally straight first bar and the isolation key defines a first isolation key; and further comprising:

a generally vertical and generally straight second bar in and extending between the concrete support and the shear key and anchored in the concrete support;

a second isolation key in the shear key, at the base of the shear key and adjacent the second bar; and a member extending between and connecting the first and second bars together.

25. The construction of claim 24 wherein the member is a plate to which upper ends of the first and second bars are welded to form an assembly of vertical bars for simultaneous placement.

26. The construction of claim 1 wherein the isolation key comprises a sleeve surrounding the generally vertical bar with spacing between the sleeve and the bar such that during a seismic event the bar is free to deform within said sleeve thus absorbing seismic energy.

27. A ductile seismic shear key construction, comprising:

a concrete support;

a shear key supported on the concrete support;

a generally vertical bar in and extending between the concrete support and the shear key and anchored in the concrete support; and an isolation key in the shear key, at a base of the shear key and adjacent to the bar;

wherein the isolation key is shaped as a prism comprising a rectangular or circular cross-section isolation block having a through-hole through which the vertical bar passes.

28. A ductile seismic shear key construction, comprising:

a concrete support;

a shear key supported on the concrete support;

a generally vertical bar in and extending between the concrete support and the shear key and anchored in the concrete support;

an isolation key in the shear key, at a base of the shear key and adjacent to the bar; and a thin layer of bond breaking material in a potential sliding interface and over a core region of the concrete shear key.

29. A ductile seismic shear key construction, comprising:

a concrete support;

a shear key supported on the concrete support;

a generally vertical bar in and extending between the concrete support and the shear key and anchored in the concrete support;

an isolation key defining an upper isolation key in the shear key, at a base of the shear key and adjacent to the bar; and a lower isolation key in the concrete support, at a top of the concrete support and adjacent the bar, wherein the upper and lower isolation keys are positioned on opposite sides of the bar.

30. A shear key construction comprising:

a concrete shear key on a support with a plane generally defined therebetween;

a ductile rod extending into both the shear key and the support, and passing through the plane;

a material adjacent the ductile rod, the material having a modulus of elasticity of 2 MPa or less; and the material being in close proximity to the plane relative to a thickness of the material such that when the shear key construction is subjected to seismic loading, the concrete shear key moves horizontally relative to the support, and the ductile rod bends into an area previously occupied by the material and takes on a doubly bent shape thereby absorbing seismic force from the seismic loading via plastic deformation of the ductile rod.

31. The construction of claim 30 wherein the material has a modulus of elasticity of between 1 and 2 MPa, and the concrete of the shear key has a modulus of elasticity of generally 23,000 to 35,000 MPa.

32. The construction of claim 30 wherein the support is a concrete support, a lower end of the ductile rod is anchored in the concrete support and the ductile rod is a steel reinforcement bar.

33. An interior shear key construction, comprising:

a concrete support;

an interior shear key supported by the concrete support and between and spaced from opposite ends of the concrete support;

a ductile bar extending between the concrete support and the interior shear key; and an isolation key in the interior shear key and generally adjacent the bar, defining an upper isolation key; and a lower isolation key in the concrete support, at a top of the concrete support and adjacent the bar, and wherein the upper and lower isolation keys are positioned on opposite sides of the bar.

34. The construction of claim 33 wherein the bar passes through a hole in the isolation key.

35. A method of constructing a shear key, comprising:

fixing a lower bar portion of a ductile bar in a concrete support;

constructing a shear key supported on the concrete support, with an upper bar portion of the ductile bar in the shear key, with the interface between the shear key and the concrete support generally defining a plane; and forming an isolation key adjacent the bar and at a base of the shear key comprising a soft material, the soft material being in close proximity to the plane relative to a thickness of the material such that when the shear key construction is subjected to seismic loading, the shear key moves horizontally relative to the support, and the ductile bar bends into an area previously occupied by the material and takes on a doubly bent shape thereby absorbing seismic force from the seismic loading via plastic deformation of the ductile bar.

36. The method of claim 35 wherein the fixing includes casting the lower bar portion in place during a concrete pouring of the concrete support.

37. The method of claim 35 wherein the fixing includes drilling a hole in the concrete support and anchoring the lower bar portion in the hole.

38. The method of claim 35 wherein the constructing includes after the fixing, positioning the isolation key adjacent an upward portion of the bar extending up from the concrete support and after the positioning pouring concrete around the upward portion and on the isolation key, and the shear key being a concrete shear key.

39. The method of claim 35 wherein the shear key defines an exterior shear key.

40. The method of claim 35 wherein the shear key defines an interior shear key.

41. The method of claim 35 further comprising after the shear key has been moderately damaged and moved from an original position to a damaged displaced position by an earthquake force, using a jack to push the shear key back to the original position.

* * * * *